United States Patent [19]

Rhoads

[11] 4,375,735

[45] Mar. 8, 1983

[54] AIR LOCK DOOR CONTROL APPARATUS

[75] Inventor: James D. Rhoads, Reading, Pa.

[73] Assignee: Dorma Door Controls Inc., Reamstown, Pa.

[21] Appl. No.: 254,425

[22] Filed: Apr. 15, 1981

[51] Int. Cl.[3] ..... E06B 7/00

[52] U.S. Cl. ..... 49/68; 49/32; 49/141

[58] Field of Search ..... 49/13, 32, 68, 141, 49/265, 274, 264

[56] References Cited

U.S. PATENT DOCUMENTS

| | | | |
|---|---|---|---|
| 2,190,653 | 2/1940 | Dunn | 49/32 |
| 3,478,468 | 11/1969 | Martin | 49/137 |
| 3,576,854 | 11/1951 | Peremi et al. | 49/141 |
| 4,222,147 | 9/1980 | Burnett, Jr. | 49/13 X |

FOREIGN PATENT DOCUMENTS

| | | | |
|---|---|---|---|
| 563609 | 9/1958 | Canada | 49/32 |

*Primary Examiner*—Kenneth Downey
*Attorney, Agent, or Firm*—Robert C. Podwil

[57] ABSTRACT

An air lock has a chamber and a pair of doors in respective walls of the chamber. Operators associated with the doors include closers normally biasing the doors to closed positions and fluid powered openers associated with the closers capable of overriding the bias of the closers. A control system, operation of which may be initiated by initial opening displacement of one of the doors or (in one embodiment of the invention) by manually operable remote switch means, provides for opening of one of the doors and latching of the other to prevent simultaneous opening of both doors. The latch means for the doors may be overriden by direct displacement of the doors for safety purposes. The control system also triggers air handling apparatus associated with the chamber.

13 Claims, 5 Drawing Figures

FIG. 1
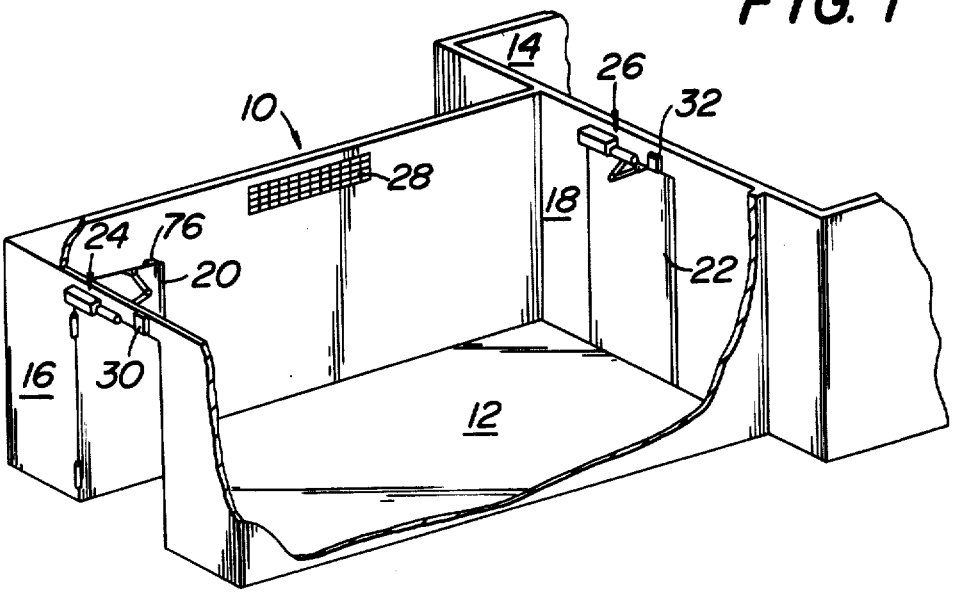
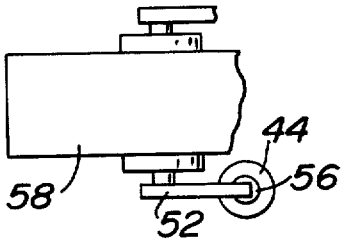
FIG. 2
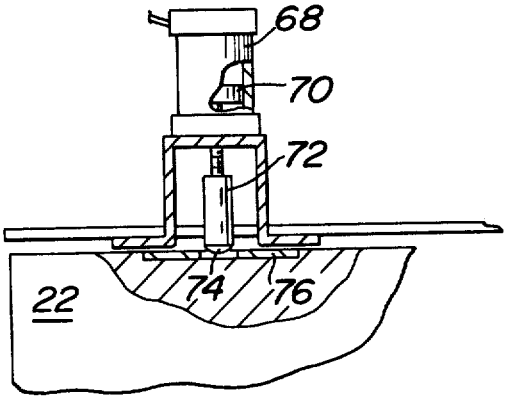
FIG. 3

AIR LOCK DOOR CONTROL APPARATUS

BACKGROUND OF THE INVENTION

This invention relates to air locks, and to the power operation of doors for air locks in a manner which maintains the security of the enclosures protected by the air locks. An aspect of the invention is the use, in an air lock, of door closer apparatus of the general type described in U.S. Pat. No. 4,222,147, issued Sept. 16, 1980, to L. Nelson Burnett, and assigned to the assignee of the present invention. In that patent, apparatus was described in which the operation of a door was achieved by means of a hydraulic door closer, overbalanced by a pneumatic actuator physically associated with the closer. In that patent and elsewhere it was proposed that such an opener be controlled by a remotely manually operable valve, such as a palm button mounted on a wall adjacent to the door, or by means responsive to initial displacement of the door (by manual pressure against the door) to override in whole or in part the closing bias of the door closer.

Apparatus for power-assisted opening of a door, with spring-urged closing, has heretofore been proposed. See, for example U.S. Pat. No. 2,190,653, issued Feb. 20, 1940 to Andrew C. Dunn, and U.S. Pat. No. 3,478,468, issued Nov. 18, 1969, to Paul W. Martin. In the Martin patent, a hydraulic door operating system was proposed in substitution for the familiar hydraulic door closer.

In certain situations, it is desirable that more than one door or door closer be operated in interrelated fashion to achieve a desired result. Air locks, for example, are intended to prevent the passage of air into or out of a protected enclosure, usually a room or enclosure in which a controlled atmosphere is essential to the activity to be carried on within the protected enclosure. For example, in a biological laboratory in which experiments or operations are conducted which relate to biologically dangerous agents, it is essential that the possibility of contamination of areas adjacent to the enclosure be eliminated. The use of an air lock is one helpful technique for doing so. Similarly, in certain biological experiments it is essential that the possibility of contamination from outside the enclosure be avoided. Here too, an air lock is useful. In the electronics industry, where it is sometimes necessary to grow pure crystalline substance and to assemble electronic components in so-called "clean" rooms, air locks are also useful.

Typically, an air lock consists of a chamber or vestibule, closed at respective ends by a pair of individually operable doors. In passing into the protected enclosure, the outer door is first opened to permit entry into the chamber or vestibule. The outer door is then closed, and the inner door opened for entry into the protected area. In leaving the protected enclosure, the sequence of operation of the doors is reversed. In some applications, the air in the chamber or vestibule is purged at an intermediate point in the process during which both doors are closed, and the present invention allows for this as well.

It is the principal object of this invention to provide an air lock and door operating apparatus for an air lock wherein operation of one of the doors may be initiated by initial opening displacement of the door or, alternatively, by manually operable remote switch means, and wherein the opening of the first door causes the second door to be latched against opening while the first door is opened. The latch means, however, in the preferred embodiment of the invention, may be overridden for safety purposes. Also, in the preferred embodiment, associated with the control system for the doors is a means for triggering air handling apparatus (which, per se, is not a part of the present invention) associated with the chamber or vestibule.

Other objects will appear hereinafter.

BRIEF DESCRIPTION

The foregoing and other objects of this invention are realized, in a presently preferred form of the invention, by an air lock apparatus which comprises an enclosed chamber and a pair of air lock doors closing respective ends of the chamber. Door operator apparatus is associated with the respective doors, and comprises a first fluid opener associated with one of the doors, and a second, similar, fluid opener operatively associated with the other of the doors. The first and second fluid openers are operatively interconnected by a control means for selectively actuating one or the other of the openers at a given time, it being understood that the openers are of the general type disclosed in the above-mentioned U.S. Pat. No. 4,222,147. These comprise spring-urged hydraulic closer means normally biasing the doors to their closed positions and fluid actuator means connected to the closer means for selectively overcoming the biasing means. The control means comprise respective switch means coupled to the first and second fluid openers for actuating the openers, and latch means coupled to the doors and responsive to the switch means to latch the other of the doors when one of the doors is opened.

The switch means may be remote manually operable means, means responsive to initial displacement of the doors, or both.

The latch means is preferably so configured and arranged as to be capable of being overridden by an application of a predetermined manual force directly to the door.

There are illustrated in the drawings forms of the invention which are presently preferred (and which constitute the best mode presently contemplated for carrying out the invention), it being understood that this invention is not limited to the precise arrangements and instrumentalities shown.

DESCRIPTION OF DRAWINGS

FIG. 1 is a perspective view showing an air lock in accordance with the present invention.

FIG. 2 is a detail view showing an aspect of a door-position responsive switch means used in the present invention.

FIG. 3 is a detail view, partially in schematic, of an overridable latch means used in the present invention.

DETAILED DESCRIPTION

Figure 4:
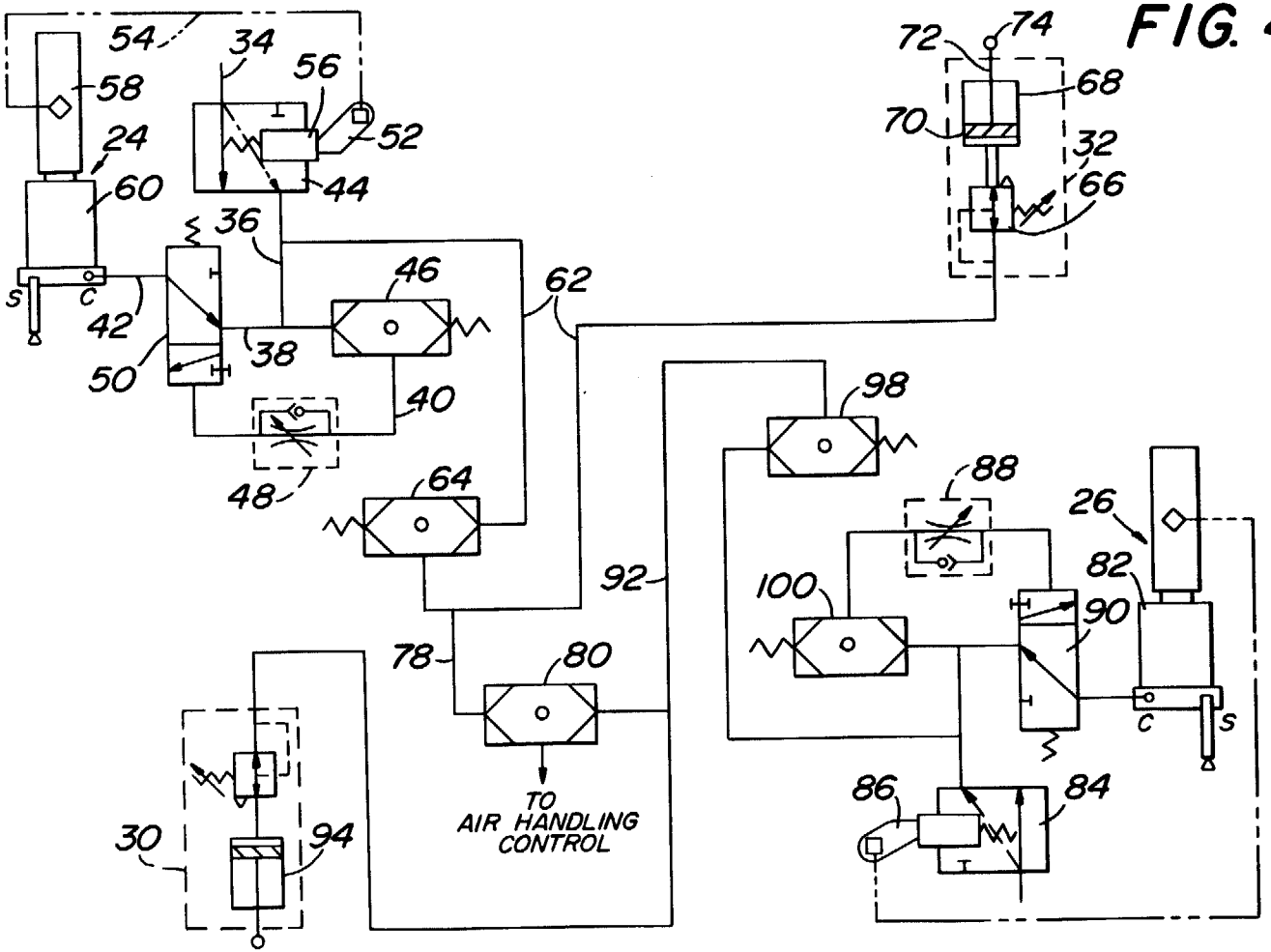
FIG. 4 is a schematic diagram showing a form of control system for use in the present invention.

Referring now to the drawings in detail, wherein like reference numerals indicate like elements, there is seen in FIG. 1 air lock apparatus designated generally by the reference numeral 10.

The air lock 10 consists of an enclosed chamber or vestibule 12, providing a passage into a protected room or enclosure 14. Respective walls 16 and 18 of the chamber 12 are provided with doors 20 and 22.

Associated with the doors 20 and 22 are respective door openers designated generally by the reference numerals 24 and 26. The chamber 12 may have within it one or more air registers 28 for changing the atmosphere of the chamber 12 by introducing to or removing from it a supply of air.

Seen diagramatically in FIG. 1 and in somewhat greater detail in FIG. 3 are latches 30 and 32, associated with the doors 20 and 22 respectively, the purpose of which will be explained in greater detail below.

Referring now to FIG. 4, there is seen, in schematic, a system by which the openers 24 and 26, and hence the doors 20 and 22, may be controlled.

A conduit 34 provides a source of filtered and regulated air which, as will be explained, may pass through additional conduits 36, 38, 40 and 42 to the opener 24. Interposed between the conduits 34 and 36 is a spool valve 44. Between the conduits 38 and 40 is a quick exhaust valve 46, and disposed within the conduit 40 is a flow control valve 48. A fluid relay valve 50 is interposed between the conduits 40 and 42. One suitable commercially available relay valve is the part sold by Numatics, Incorporated, of Highland, Mich., as the "Numatrol II" relay valve.

The system as shown in FIG. 4 is configured as it would be with its air supply on, and with both doors closed.

Referring now to FIG. 2 in addition to FIG. 4, when the door 20 is closed, a drive cam 52 associated with the output (drive) shaft 54 of the opener 24 depresses the actuator 56 of the spool valve 44. Initial motion of the door 20 to a slightly opened position causes withdrawal of the drive cam 52 from its actuator-depressing position, and permits the valve 44 to open. Opening the valve 44 upon initial motion of the door 20 pressurizes the conduits 36, 38 and 40 as well as the conduit 42.

As is described in the above-mentioned U.S. Pat. No. 4,222,147, the openers 24 and 26 function under ordinary circumstances as conventional door closers, to normally bias doors, such as the doors 20 and 22, to closed positions. With reference to FIGS. 1 and 4, the door "closer" portion of the opener 24 is designated by the reference numeral 58. Associated with the closer portion is a fluid actuator 60, mechanically connected to the closer portion 58 and capable of overcoming the bias of the closer portion 58.

The conduit 42 supplies control pressure to the actuator 60 of the opener 24. The application of such pressure to the fluid actuator 60 through the conduit 42 causes operation of the fluid actuator 60 to open the door 20. After a time lapse determined by the construction of the opener 24, the door 20 is permitted to close. One suitable opener for use as the opener 24 is the unit sold by the assignee of this application as the Model 1120 opener. The internal operation of such a unit in response to a control signal is described in detail in pending application Ser. No. 153,741, filed May 27, 1980, by L. Nelson Burnett, Jr., and assigned to the assignee of the present invention.

Control pressure is applied to the fluid actuator 60 upon opening of the spool valve 44. Also, upon opening of the spool valve 44, control pressure is introduced to the conduit 40 and begins to build up downstream of the flow control valve 48. When, in accordance with a time constant characteristic of the flow control valve 48, control pressure builds up in the relay valve 50, the relay valve 50 is caused to shift, thus cutting off the control pressure to the fluid actuator 60 and permitting relief of the fluid actuator 60.

Referring again to FIG. 4, a conduit 62 branches from the conduit 36, passes through a quick exhaust valve 64 and a pressure regulator 66 to a latch cylinder 68 associated with the latch 32. Thus, pressurization of the conduit 36 also results in pressurization of conduit 62 and the latch cylinder 68.

Referring now to FIG. 3, a piston 70 associated with the latch cylinder 68 has a rod 72 to which is affixed a roller 74. The roller 74 rollingly engages a striker cam 76 associated with the door 22. Engagement of the roller 74 with the cam 76 causes the door 22, by virtue of the pressure in the latch cylinder 68, to be latched in the closed position, thus ensuring the integrity of the enclosure 14 as the door 20 opens. It should be understood, however, that in the event of an emergency requiring opening of the door 22, the latching force provided by the latch 32 could be overcome by a person of average strength applying opening force to the door 22.

Referring now to FIG. 4, a conduit 78 branching from the conduit 62 contains a shuttle valve 80, the purpose of which is to control air flow within the chamber 12. The precise means and instrumentalities for controlling the air flow, it should be understood, or not, per se, a part of the present convention. Pressurization of the conduit 78 causes movement of the shuttle valve 80 to a position whereby a control signal is sent to air handling apparatus.

It should be apparent that the control means associated with the opener 26 and door 22 is essentially the same in its configuration and mode of operation as the one described above. Thus, the opener 26 includes a fluid actuator 82 which corresponds in all respects to the above-described fluid actuator 60. The fluid actuator 82 is controlled by a spool valve 84, normally held closed by a drive cam 86 like the drive cam 52. Similarly, the spool valve 84 controls, through appropriate conduits and a flow control valve 88 a relay valve 90. A conduit 92 provides fluid communication between the control circuit for the opener 26 and a latch cylinder 94 associated with a pressure regulator 96, identical in its structure and function to the above-described latch cylinder 68. The latch cylinder 94, however, is associated with the latch 30 for the door 20. Initial opening, therefore of the door 22 serves as in the above-described case, to cause movement of the door 22 to its open position and simultaneously to latch the door 20. As before in the case of the door 22, latching is subject to manual override.

The above mentioned quick exhaust valves 46 and 64, and analogous quick exhaust valves 98 and 100 associated with the fluid actuator 60, assure a rapid rate of response in the control system, as is necessary in situations in which rapid passage is desired through the air lock 10.

Figure 5:
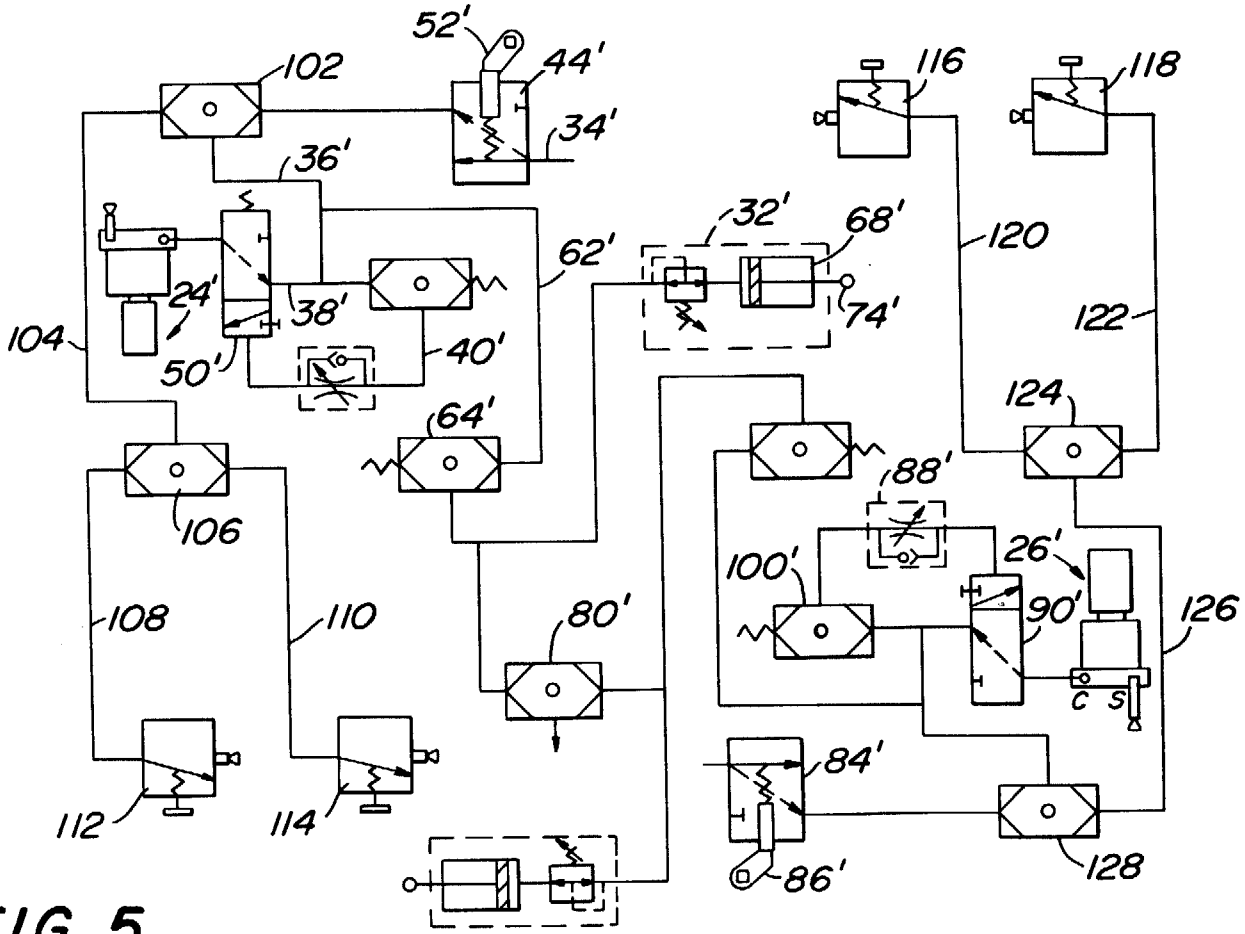
FIG. 5 is a schematic diagram showing an alternative form of control system.

Referring now to FIG. 5, wherein elements corresponding to those previously described are identified by like primed (') reference numerals, there is seen an embodiment wherein air lock doors and latches may be operated by either initial displacement of a door or remotely operable manual switches.

In this embodiment, a conduit 34' provides air through a shuttle valve 102 and conduits 36', 38', 40' and 42' to an opener 24'. Interposed between the conduits 34' and 36' is a spool valve 46', and disposed within the conduit 40' is a flow control valve 48'. A fluid relay valve 50', like the relay valve 50, is interposed between the conduits 40' and 42'.

Also connected to the shuttle valve 102, and through the shuttle valve 102 to the conduit 36', is a conduit 104. The conduit 104 is associated with the outlet side of still another shuttle valve 106. The respective input sides of the shuttle valve 106 are associated with respective conduits 108 and 110 and respective push button valves 112 and 114. The push button valves 112 and 114 are normally closed, but when displaced to their open positions they place the respective conduits 108 or 110 in fluid communication with a source of pressure. Thus, actuation of, for example, the push button valve 112 charges the conduit 108, and causes the shuttle valve 106 to shift (to the right in FIG. 5) to permit communication between the conduits 108 and 104. Pressure in conduit 104, in turn, causes shifting of the shuttle valve 102 to the right in the Figure, and places the conduit 104 in fluid communication with conduit 36'. In a like manner, actuation of the push button valve 114 causes pressurization of the conduit 110 and shifting of the shuttle valve 106 to left in FIG. 5, to place conduit 110 in fluid communication with the conduit 104. As before, pressurization of conduit 104 causing shifting of shuttle valve 102 to the right in the Figure, to place conduit 104 in the fluid communication with conduit 36'.

It should now be apparent that in the embodiment described above and illustrated in FIG. 5, operation of one or the other of the push button valves 112 and 114 or operation of spool valve 44' in response to initial opening of one door serves to actuate the fluid actuator 60'. As in the case of the earlier-described embodiment, actuation of the fluid actuator 60' associated with the opener 24' also causes operation of a latch cylinder 68' associated with the latch 32' and a door 22' (not shown).

The above-described arrangement of the push button valves 112 and 114 and shuttle valves 106 and 102 is mirrored in the portion of the control system associated with the opener 26'. In this instance, push button valves 116 and 118 are associated with respective conduits 120 and 122. The conduits 120 and 122 are associated with opposite sides of a shuttle valve 124, which communicates at its outlet side with a conduit 126. Conduit 126 is associated with one side of still another shuttle valve 128, corresponding in its function to the above-described shuttle valve 102. Thus, operation of one or the other of the push button valves 116 and 118 can initiate operation of the opener 26', as can operation of spool valve 84' by opening of the door 22'.

The push button valves 112–118 may be located as desired with respect to the doors which they control, and in association with the further alternative form of operation provided by the door-actuated spool valves 44' and 84', provide the apparatus with great flexibility and convenience of operation.

The present invention may be embodied in other specific forms without departing from its spirit or essential attributes, and accordingly, reference should be made to the appended claims rather than the foregoing specifications as indicating the scope of the invention.

I claim:

1. Air lock apparatus comprising an enclosed chamber, a pair of air lock doors closing respective ends of the chamber, door operator apparatus comprising a first fluid opener operatively associated with one of said doors, a second fluid opener operatively associated with the other of said doors, and control means for selectively actuating one or the other of said openers at a given time, said openers comprising closer means normally biasing said doors to their closed positions and fluid actuator means connected to said closer means for selectively overcoming said biasing means and causing the door to open, said control means comprising respective switch means coupled to said first and second fluid openers for actuating said openers, and respective latch means coupled to said doors and responsive to said switch means to latch the other of said doors closed when one of said doors is opened.

2. Apparatus in accordance with claim 1, wherein said latch means are so configured and arranged as to be capable of being overriden by the application of manual force to the door.

3. Apparatus in accordance with claim 2, wherein said switch means comprises valve means responsive to initial displacement of one of said doors to actuate the opener for said one door and the latch means for the other of said doors.

4. Apparatus in accordance with claim 3, wherein said valve means is a pneumatic valve.

5. Apparatus in accordance with claim 2, wherein said switch means comprises respective manually operable valve means disposed adjacent said doors, whereby operation of one of said valve means actuates the opener for one of the doors and the latch means for the other of the doors and operation of the other of said valve means actuates the opener for the other of the doors and the latch means for said one of the doors.

6. Apparatus in accordance with claim 3, wherein said switch means further comprises respective manually operable valve means disposed adjacent said doors, whereby operation of one manually operable valve means actuates the opener for one of said doors and the latch means for the other of the doors and operation of the other manually operable valve means actuates the opener for the other of the doors and the latch means for said one of the doors.

7. Apparatus in accordance with claim 3, and valve means operatively coupled to said control means and responsive thereto and adapted to control the atmosphere in the vestibule.

8. In air lock apparatus comprising an enclosed chamber and a pair of air lock doors closing respective ends of the chamber, door operator apparatus comprising a first fluid opener operatively associated with one of the doors, a second fluid opener operatively associated with the other of said doors, and control means for selectively actuating one or the other of said openers at a given time, said openers comprising closer means normally biasing said doors to their closed positions and fluid actuator means connected to said closer means for selectively overcoming said biasing means and causing the door to open, said control means comprising respective switch means coupled to said first and second fluid openers for actuating said openers, and respective latch means coupled to said doors and responsive to said switch means to latch the other of said doors closed when one of said doors is opened.

9. Apparatus in accordance with claim 8, wherein said latch means are so configured and arranged as to be capable of being overriden by the application of manual force to the door.

10. Apparatus in accordance with claim 9, wherein said switch means comprises valve means responsive to initial displacement of one of said doors to actuate the opener for said one door and the latch means for the other of said doors.

11. Apparatus in accordance with claim 9, wherein said switch means comprises respective manually operable valve means disposed adjacent said doors, whereby operation of one of said valve means actuates the opener for one of the doors and the latch means for the other of the doors and operation of the other of said valve means actuates the opener for the other of the doors and the latch means for said one of the doors.

12. Apparatus in accordance with claim 10, wherein said switch means further comprises respective manually operable valve means disposed adjacent said doors, whereby operation of one manually operable valve means actuates the opener for one of said doors and the latch means for the other of the doors and operation of the other manually operable valve means actuates the opener for the other of the doors and the latch means for said one of the doors.

13. Apparatus in accordance with claim 12, and valve means operatively coupled to said control means and responsive thereto and adapted to control the atmosphere in the vestibule.

* * * * *